US006273735B1

(12) United States Patent
Johnson et al.

(10) Patent No.: US 6,273,735 B1
(45) Date of Patent: Aug. 14, 2001

(54) ROTATING TURRET SIDE-ENTRY RETRACTABLE JACK

(75) Inventors: Thomas A. Johnson, Draper; Tim Urry Price, Salt Lake City, both of UT (US)

(73) Assignee: 3Com Corporation, Santa Clara, CA (US)

( * ) Notice: Subject to any disclaimer, the term of this patent is extended or adjusted under 35 U.S.C. 154(b) by 0 days.

(21) Appl. No.: 09/696,044

(22) Filed: Oct. 25, 2000

(51) Int. Cl.[7] ..... H01R 13/44
(52) U.S. Cl. ..... 439/131; 439/22
(58) Field of Search ..... 439/131, 11, 13, 439/15, 20, 21, 22, 23, 24, 25, 29

(56) References Cited

U.S. PATENT DOCUMENTS 5,499,923 * 3/1996 Archibald et al. ..... 439/26
5,634,802 * 6/1997 Kirklaan ..... 439/131
6,164,989 * 12/2000 Glad et al. ..... 439/131

* cited by examiner

*Primary Examiner*—Tulsidas Patel
(74) *Attorney, Agent, or Firm*—Workman, Nydegger & Seeley

(57) ABSTRACT

An extendable/retractable media connector for extending from an electronic device such as a PCMCIA type-III card or other electronic device. The connector includes a slidable extendable/retractable frame having an aperture therein for physically receiving a media plug. The aperture further includes electrical contacts for operably mating with complementary contacts on the media plug. The connector further includes a rotatable electrical interface between the fime, a portion of which may be physically attached to the frame in the form of electrical tracks, which provides commutator-like electrical coupling between the electrical contacts in the aperture and electronic circuitry within the electronic device or card. The connector provides rotational freedom to the media connector and any accompanying cabling while coupled with the connector and further facilitates various angles of insertion of the media plug into the connector for user convenience and ease of attachment.

28 Claims, 5 Drawing Sheets

ROTATING TURRET SIDE-ENTRY RETRACTABLE JACK

BACKGROUND OF THE INVENTION

1. The Field of the Invention

The present invention relates to electrical interface connections. More particularly, it relates to extendable media connectors that are configured to couple with physical/electrical media plugs.

2. The Relevant Technology

The ability to freely access data on a network and to transfer information between electrical apparatus can dramatically increase productivity and reduce overall production time. Accordingly, electrical apparatus have been equipped with means to access electronically retrievable data over networks, such as the Internet, a world wide network, local area networks ("LANs") and wide area networks ("WANs"). The transfer of data over a network can be accomplished with wireless technology or by telephone lines and cables. The interface between a computer and a cable or telephone line is typically accomplished through a media connector.

One conventional type of media connector is the Registered Jack connector (RJ-series connector). RJ-series connectors are used by almost all telephone companies throughout the world for many applications, the most important of which is interconnection of telephones with telephone lines. For this reason, stringent standardization of connectors has been established to enable compatibility and interactivity. Due to the simplicity of the connection and the established standards, RJ-series connectors are used extensively in the computer industries and in other industries where communication over telephone lines or other types of cables is required.

RJ-series connectors include a plug or contact block and a receptacle or socket. The plug comprises a small block shaped body coupled with a cable, such as a telephone line. Housed within the body are several contact pins. Each of the contact pins is attached to a discrete wire within the cable. Mounted on the outside of the body is a flexible retention clip that is used for removably securing the body of the plug within the socket of an electrical apparatus.

The socket is typically formed on the side of the electrical apparatus and is configured to receive the plug. Disposed within the socket are electrical contact wires. During use, the contact wires within the socket are biased against corresponding contacts on the plug to complete an electrical connection between the plug and the electrical apparatus.

The interior surface of the socket comprises a latching mechanism that receives the retention clip of the plug so as to mechanically secure the plug within the socket by holding retention notches of the retention clip securely in place. To remove the plug, the retention clip is manually flexed towards the body of the plug to release the hold of the latching mechanism on the retention notches, thereby enabling manual removal of the plug from the socket.

As the computer industry continues to develop, new peripheral devices are created that enable users to freely access data on networks and to transfer information between electrical apparatus. There are many types of peripheral devices, including, but not limited to wireless cellular modems, facsimile modems, modular random access memory, and network interface connectors. However, because of size constraints, most computers, particularly portable computers, are designed to incorporate only some of the available peripheral devices. Incorporating every available device into a single computer would substantially increase the price of the computer while decreasing its portability. Furthermore, a computer user may not require or desire all of the available peripheral devices. Accordingly, the computer industry has developed standards that enable a computer user to selectively integrate and interchange various peripheral devices.

These standards have been promulgated by the Personal Computer Memory Card International Association (PCMCIA). PCMCIA standards specify spatial size restrictions and coupling interface restrictions. According to PCMCIA standards, there are three types of card architectures. A type-I PCMCIA card has a thickness of approximately 3.3 mm. A type-II PCMCIA card has a thickness of approximately 5 mm. A type-III PCMCIA card has a thickness of approximately 10.5 mm. Each of these card types also have a 68-pin female connector, a width of 55 mm, a length of 85 mm, and edges that are configured to slidably engage channels of a corresponding expansion slot in an electronic apparatus.

PCMCIA standards enable a computer user to selectively use a first peripheral device and later remove it when it is no longer needed. This is particularly useful because it enables a computer user to interchange peripheral devices based on particular needs. When a PCMCIA card is used to access a network or to transfer information between electrical apparatus, the PCMCIA card must be provided with an interface to a media link or media plug. One way to interface a PCMCIA card with an appropriate media plug is to use an adapter. One skilled in the art will recognize a dongle as a typical adapter. Although dongles and other adapters provide one means for interconnecting media plugs with PCMCIA cards, they are also problematic. In particular, they have to be stored and they can easily be misplaced.

One alternative to adapters is to design a socket into the PCMCIA card so that it can directly interface with an appropriate media plug. This is a viable solution for the thicker type-III PCMCIA cards. One problem encountered by this solution, however, occurs during nonuse, when the socket is not occupied by a media plug and is left open to the environment. This is a problem because the socket becomes a sink for dust and debris, which is harmful if it accumulates and prevent the contact pins of the media plug from successfully interfacing with the PCMCIA card. Debris and exposure to the environment can also cause ancillary damage to electrical contact wires within the PCMCIA card. For example, an object inadvertently inserted into the socket may electrically short out or physically deform the electrical contact wires of the PCMCIA card. One solution to these problems is to cap the socket with a plug during nonuse to protect it from harmful dust and debris. However, this solution has its own problems. As with adapters, plugs require additional handling, they must be stored and they can easily be misplaced. Accordingly, it would, therefore, be desirable to provide a media connector that can protect the socket and electrical contact wires from harmful dust and debris during nonuse without having to store additional components such as plugs.

Another problem encountered by traditional sockets is that they cannot accommodate both RJ-11 series plugs and RJ45 series plugs. Typically, RJ-11 series plugs are used as an interface to connect to the internet or for standard modem applications using normal telephone lines. RJ45 series plugs are typically used as an interface to connect to LANs. The body of an RJ-45 series plug is wider than the body of an RJ-11 series plug because it houses eight contact wires, whereas, the RJ-11 series plug houses only four or six contact wires. Accordingly, a socket that is configured to accommodate an RJ-11 series plug is too narrow to receive the body of an RJ-45 series plug. And a socket that is configured to couple an RJ-45 series plug is too wide to securely couple with an RJ-11 series plug because the space between the socket walls and the body of the RJ-11 series plug allows the plug to wiggle back and forth. Accordingly, it would be desirable to provide a media connector that can securely accommodate both RJ-11 and RJ-45 series media plugs so that only a single media connector is required for a PCMCIA card to access both the internet and LAN's.

Another problem encountered by traditional sockets is that they are configured to couple with a media plug from only a single direction. For example, when a media plug is attached to a very short cord its mobility is limited, restricting the directions from which it can be inserted into a socket. Yet another problem encountered by incorporating traditional sockets into an electrical apparatus or peripheral computer card device is that visibility to the socket is restricted because the socket is recessed beyond the profile of the electrical apparatus. Although a computer user may lean over to view the socket while manipulating the media plug into the socket, it is often necessary to move the electrical apparatus to provide a better angle of vision before the media plug can be successfully navigated into the socket. Accordingly, it would, therefore, be desirable to provide a media connector that can easily be coupled with media plugs from different angles of orientation without requiring the electrical apparatus to be moved and without requiring the computer user to exert undue effort.

BRIEF SUMMARY OF THE INVENTION

To achieve the foregoing objects, and in accordance with the invention as embodied and broadly described herein, an extendable media connector is provided for coupling with RJ-series media plugs.

The RJ-series media plug comprises a small block shaped body coupled with a cable, such as a telephone line. A flexible retention clip is mounted to the body of the plug and protrudes away from the body at a slight angle, terminating at a narrow free end. The retention clip has retention notches that define the edges where the retention clip significantly narrows. Housed within the plug body are distinct contact pins. Each of the contact pins is attached to a discrete wire within the cable.

The extendable media connector of the present invention comprises a frame, a rotatable electrical interface and electrical contacts. The frame is rotatably mounted to a type-III PCMCIA card housing and is slidably retractable into the housing of the PCMCIA card. The frame has an aperture that extends into the side of the frame and is configured to couple with a corresponding physical/electrical media plug. When the frame is retracted into the housing of the PCMCIA card, the aperture is sheltered and protected from dust and debris.

The aperture is configured to couple with both RJ-11 and RJ-45 media plugs. When such a media plug is inserted into the aperture, the electrical contacts of the extendable media connector bias against the contact pins of the media plug, effectuating an electrical connection between the media plug and the PCMCIA card through a rotatable electrical interface. The rotatable electrical interface enables the frame to rotate while maintaining an electrical connection between the media plug and the PCMCIA card. The rotatable electrical interface is useful because it enables a media plug to be coupled with a PCMCIA card from various angles of orientation.

The frame mechanically secures the media plug within the aperture by latching onto the retention notches of the retention clip. After use, the media plug can be removed from the aperture by manually flexing the retention clip towards the body of the plug. This releases the hold of the frame on the retention notches of the retention clip and allows the media plug to be freely removed.

It should be appreciated that the extendable media connector of the present invention may be modified without departing from the spirit of the present invention. For example, the frame of the extendable media connector may comprise various shapes and configurations. In particular, the rotatable electrical interface may also comprise various configurations of armatures and commutators.

In one embodiment, the frame is rotatably connected to a type-III PCMCIA card and comprises a rectilinear block that is slidably retractable into the housing of the PCMCIA card. In this embodiment, the rotatable electrical interface may include a substantially flat surface having a plurality of electrical tracks that make contact with electrical brushes of the PCMCIA card. In an alternative configuration, the rotatable electrical interface may include an armature that makes electrical contact with brushes of the PCMCIA card. The rotatable electrical interface may also include brushes that are attached to the frame and make contact with electrical tracks of the PCMCIA card.

In another embodiment, the frame is rotatably connected to a type-III PCMCIA card and comprises a cylindrical block that is slidably retractable into the PCMCIA card housing. In this embodiment, the rotatable electrical interface may include a substantially flat surface having a plurality of electrical tracks or an armature that makes contact with electrical brushes of the PCMCIA card. Alternatively, the rotatable electrical interface may include brushes that are attached to the frame and make contact with electrical tracks of the PCMCIA card.

In yet another embodiment, the frame comprises a cylindrical block that is rotatably mounted to a rectilinear block that is slidably retractable within a type-III PCMCIA card housing. In this embodiment, the rotatable electrical interface is attached to the cylindrical block and includes a plurality of electrical tracks that are disposed on a substantially flat surface at the end of the cylindrical block. The electrical tracks make contact with corresponding electrical brushes housed within the rectilinear block. In an alternative configuration of this embodiment, the rotatable electrical interface may include brushes that are attached to the frame and make contact with electrical tracks of a PCMCIA card that are mounted on the slidably retractable rectilinear block. It is also possible for the electrical tracks to be disposed around a shaft running through the center of the cylindrical block that make contact with electrical brushes located on the cylindrical block.

In yet another embodiment, the slidably retractable frame may retract directly into the body of the host system or device wherein an intermediary PCMCIA card is not employed. In such an embodiment, the extendable media connector directly mounts to the circuitry within the host or device system.

One of the benefits of the present invention is that it provides an extendable media connector that can couple with both RJ-11 series plugs and RJ45 series plugs from various angles of orientation. The present invention also provides a flexible and mobile connection between the extendable media connector of the present invention and a suitable physical/electrical media plug while protecting the aperture and electrical contacts of the extendable media connector from ancillary damage and the accumulation of harmful dust and debris. These and other objects and features of the present invention will become more fully apparent from the following description and appended claims, or may be learned by the practice of the invention as set forth hereinafter.

BRIEF DESCRIPTION OF THE DRAWINGS

In order that the manner in which the above-recited and other advantages and features of the invention are obtained, a more particular description of the invention briefly described above will be rendered by reference to specific embodiments thereof which are illustrated in the appended drawings. Understanding that these drawings depict only typical embodiments of the invention and are not therefore to be considered limiting of its scope, the invention will be described and explained with additional specificity and detail through the use of the accompanying drawings in which.

DETAILED DESCRIPTION OF THE PREFERRED EMBODIMENTS

The present invention relates to extendable media connectors for coupling with physical/electrical media plugs.

The extendable media connector of the present invention is configured to electrically and mechanically couple with a corresponding physical/electrical media plug, hereinafter "media plug." Examples of media plugs include, but are not limited to, RJ-11 and RJ45 series plugs. In many of the depicted examples, the inventive modular jack is configured to receive RJ-series plugs. However, it should be appreciated that the present invention contemplates that it would be obvious to one skilled in the art based on the present disclosure to modify the depicted modular jack to receive other types of media plugs including nonstandard plugs and media plugs that are developed or standardized in the future.

The term "electrical apparatus," as used in the specification and appended claims, is broadly intended to include any apparatus having electrical components. By way of example and not limitation, some of the more conventional electrical apparatus include: network computers, laptop computers, personal computers, notebook computers, PDA's, and modems. Non-conventional electrical apparatus can include, among other things, televisions, stereo equipment, other electrical musical devices, electrical tools, electrical appliances, and automobiles.

The extendable media connector of the present invention is depicted in the preferred embodiments as being connected to a conventional type-III PCMCIA card. However, it should be appreciated that the extendable media connector of the present invention can be modified and attached directly to various peripheral computer devices or electrical apparatus without departing from the spirit of the present invention.

Figure 1:
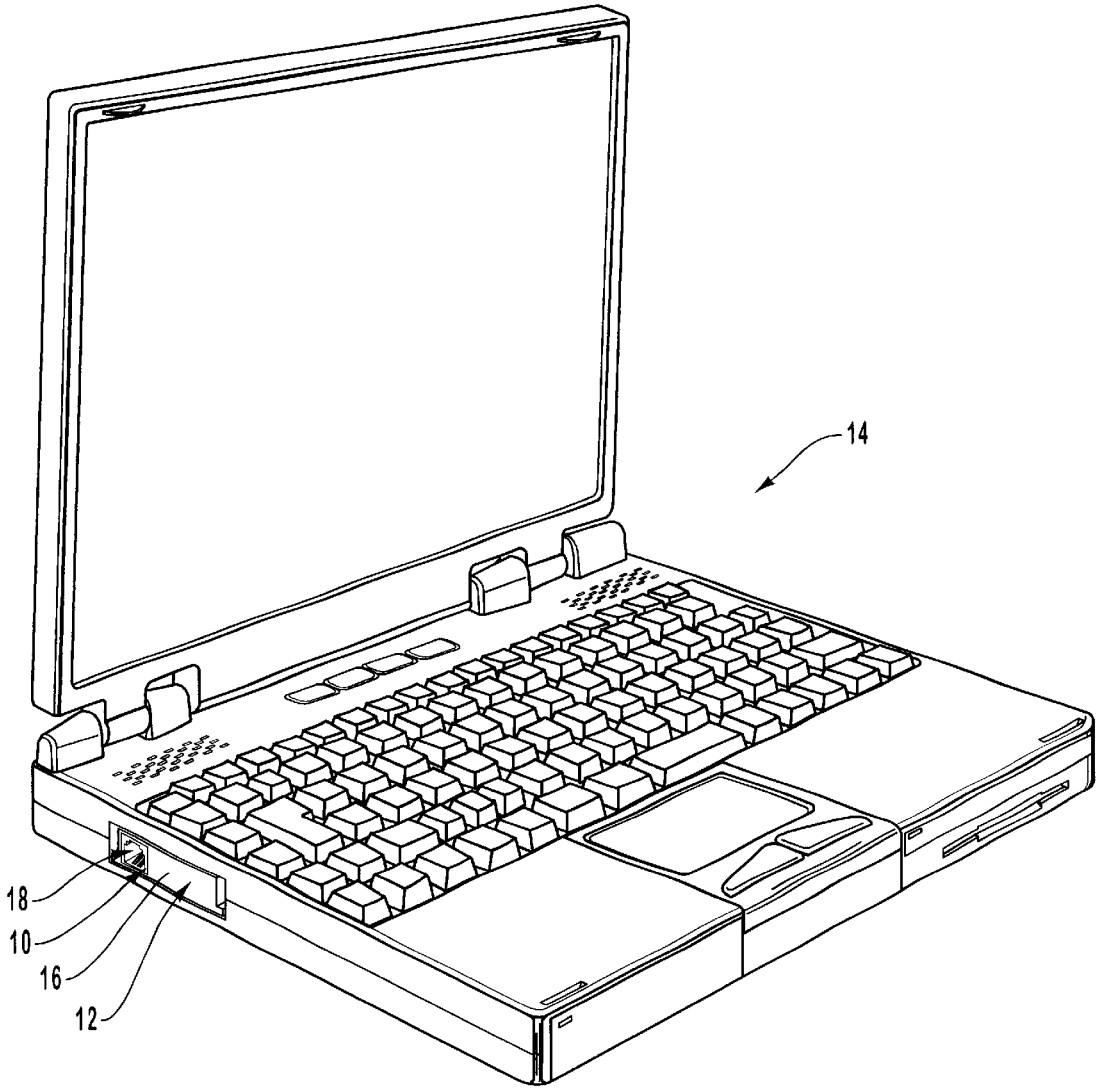
FIG. 1 is a perspective view of an electrical apparatus with a communications card device that includes one embodiment of an extendable media connector of the present invention that is retractably mounted to communications card device.

As depicted in FIG. 1, the extendable media connector 10 of the present invention is connected to a communications card device 12 that can be inserted into an expansion slot of an electrical apparatus 14. In one presently preferred embodiment, the communications card device 12 has a type-III PCMCIA card housing 16. However, it should be appreciated that the extendable media connector 10 of the present invention can be modified to connect to a variety of peripheral communications card devices 12 and may even be modified to connect directly to an electrical apparatus 14.

The extendable media connector 10 has an aperture 18 that is configured to couple with a media plug 20. In FIG. 1, the aperture 18 is shown to be open and exposed to the environment and is located at the end of the extendable media connector 10. In other embodiments, as will be described herein, the aperture 18 is hidden within the housing 16 of the communications card device 12, during nonuse, when it is not coupled with a media plug 20.

Figure 2:
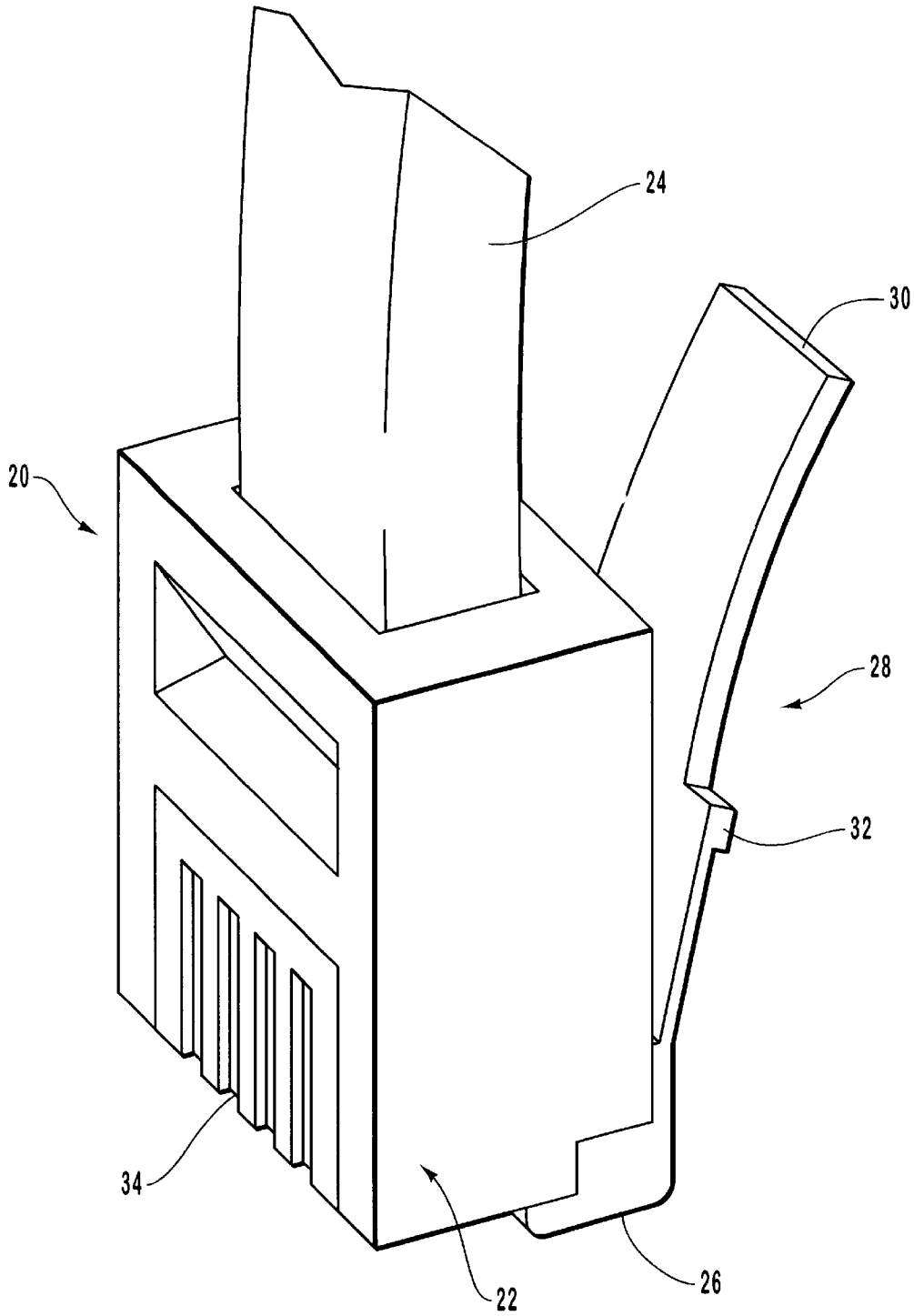
FIG. 2 (PRIOR ART)
FIG. 2 illustrates a perspective view of one presently preferred embodiment of a physical/electrical media connector that is suitably configured to be coupled with the extendable media connector of the present invention.

FIG. 2 illustrates a typical embodiment of a media plug 20 that is suitable for coupling with the extendable media connector 10 of the present invention. As shown, the media plug 20 comprises a small block shaped body 22 coupled with a cable 24, such as a telephone line. The plug body 22 has a plug nose 26 extending away from the body 22 in the opposite direction of the cable 24. A flexible retention clip 28 is mounted on the plug nose 26 and protrudes away from the plug body 22 at a slight angle, terminating at a narrow free end 30. The retention clip 28 has retention notches 32 that define the edges where the retention clip 28 significantly narrows. Housed within the plug body 22 are distinct contact pins 34. Each of the contact pins 34 is attached to a discrete wire within the cable 24. During use, when the media plug 20 is inserted into the aperture 18, the electrical contacts 42 of the extendable media connector 10 bias against the contact pins 34 of the media 20, thereby providing an electronic link between the media plug 20 and the communications card device 12 via the extendable media connector 10.

When a media plug 20 as described, is inserted into the aperture 18 of the extendable media connector 10, retention tabs 44 latch onto the retention notches 32 of the retention clip 28. This mechanically secures the media plug 20 within the aperture 18. To remove the media plug 20 from the aperture 18, the free end 30 of the retention clip 28 is flexed towards the body 22 of the media plug 20. This releases the hold that the retention tabs 44 have on the retention notches 32, allowing the media plug 20 to be freely removed from the aperture 18.

In the preferred embodiment, the aperture 18 is configured to receive both RJ-11 and RJ-45 series media plugs 20. It should be appreciated that this is a useful improvement over traditional sockets that can securely accommodate only a single type of media plug 20. Traditional sockets that accommodate RJ-45 series plugs 20 must be at least as wide as the RJ-45 series plug body 22, which is too wide to securely couple with the narrower RJ-11 series plugs 20 because the space between the socket walls and the body 22 of an RJ-11 series plug 20 allows the plug to wiggle back and forth. In contrast, a socket that is configured to securely accommodate an RJ-11 series plug 20 is too narrow to receive the body 22 of an RJ45 series plug 20.

The present invention in one embodiment overcomes these problems by providing an aperture 18 that is wide enough to receive both RJ-11 and RJ-45 series media plugs 20 while providing alignment surfaces 46 that slidably engage the retention clip 28 of the media plug 20, and align the media plug 20 within the aperture 18. This alignment is secured when the retention tabs 44 of the frame 50 mechanically latch onto the retention notches 32 of the retention clip 28, holding the media plug 20 securely in place. Apertures designed for only a specific dimension media plug are also contemplated within the scope of the present invention.

Figure 3:
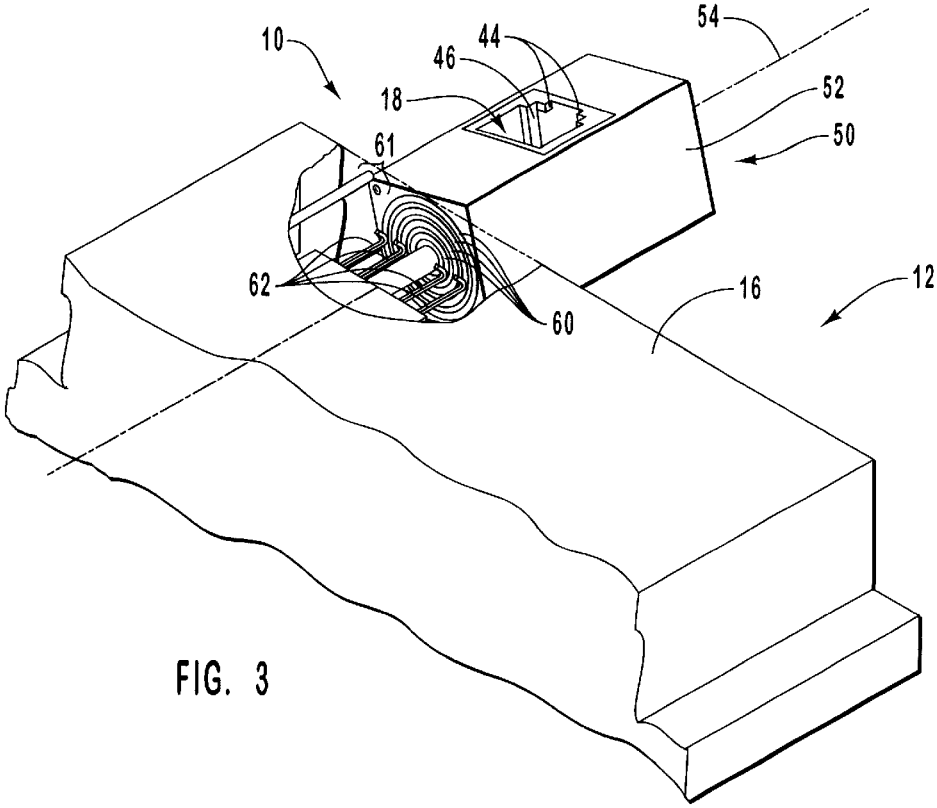
FIG. 3 illustrates a back perspective view of one presently preferred embodiment of the extendable media connector of the present invention that includes an aperture extending into a rectilinear and slidably retractable frame, electrical contacts, and a rotatable electrical interface comprising a plurality of electrical tracks that are in contact with electrical brushes of a communications card device.

FIG. 3 illustrates a perspective view of one presently preferred embodiment of the extendable media connector 10 of the present invention. As shown, the extendable media connector 10 comprises a frame 50. In this embodiment, the frame 50 comprises a rectilinear block 52 having an aperture 18 that extends therein. The aperture 18 is configured to receive the body 22 of an appropriate media plug 20, as described above. During normal use, the frame 50 protrudes out of the communications card device 12, as shown in FIG. 3 so that a media plug 20 can be inserted into the aperture 18. During normal nonuse, the frame 50 is slidably retracted into the housing of the communications card device 12, as shown in FIG. 1.

Although FIG. 1 depicts an aperture 18 extending into the end of the frame 50, this is only one possible location for the aperture 18. In other embodiments, the aperture 18 extends into the side of the frame 50, as shown in FIG. 3, to provide a means for sheltering the aperture 18 during nonuse so that it does not become a sink for the harmful accumulation of dust and debris. Dust and debris can be harmful when it accumulates within the aperture 18 and prevents the contact pins 34 of a media plug 20 from completing an electrical connection with the electrical contacts 42 of the extendable media connector 10. The electrical contacts 42 are depicted in FIGS. 4 and 6–8. Sheltering the aperture 18 during nonuse also proves to be beneficial for protecting the electrical contacts 42 from ancillary damage, such as electrical shorts and physical deformation. Damage and can occur, for example, when an object is inadvertently inserted into the aperture 18 during nonuse.

In the presently preferred embodiment, the frame 50 is rotatably mounted to the communications card device 12 and can freely rotate about a central axis 54 that extends through the center of the frame 50. When the frame 50 is rotated about the central axis 54 then the aperture 18 is also forced to rotate about the same axis 54. One of the benefits of having a frame 50 that can rotate is that it enables a media plug 20 to be coupled with the extendable media connector 10 from various angles. One reason this is useful is because it facilitates the insertion of a media plug 20 into the aperture 18 by providing a user with better visibility to the aperture 18 while inserting a media plug 20 into the aperture 18. Another benefit is that a user can rotate the aperture 18 to the most convenient position for coupling with a media plug 20. The most convenient position will vary, depending on personal preferences and environmental conditions. One practical example, illustrating the usefulness of having a rotating frame 50, occurs when the extendable media connector 10 of the present invention is coupled with a media plug 20 that is attached to a very short cable 24. The short cable 24 limits the mobility of the media plug 20 so that it can only be coupled with the extendable media connector 10 from certain angles of insertion. However, the rotatably mounted frame 50 can be rotated until the aperture 18 faces the media plug 20, enabling the media plug 20 to be inserted into the aperture 18, despite the constraints of the short cable 24.

Another benefit of having a rotating frame 50 is to prevent or minimize damage to a cable 24 attached to a media plug 20, the media plug 20 itself, and the extendable media connector 10. For example, when an inadvertent force is applied to a cable 24 of a media plug 20 that is already coupled with a media connector 10, tension is created that can break or deform the cable 24, the media plug 20, and the media connector 10. However, if the frame 50 is free to rotate, as in the presently preferred embodiment, the frame 50 can provide slack to the cable 24, minimizing the potential for damage.

FIG. 3 also illustrates a rotatable electrical interface that enables the extendable media connector 10 of the present invention to maintain an electrical connection between a media plug 20 and the communications card device 12 even when the frame 50 is being rotated. As shown, the rotatable electrical interface comprises a plurality of electrical tracks 60 that are mounted on a substantially flat surface of the back of the frame 50. Each electrical track is attached to an individual electrical contact and a corresponding electrical brush of the communications card device 12. When a media plug 20 is inserted into the aperture 18, each contact pin of the media plug 20 is electronically connected to a corresponding electrical contact, electrical track, and electrical brush, thereby completing an electrical connection between the media plug 20 and the communications card device 12.

Because the rotatable electrical interface is mounted to the frame 50, electrical contact between the electrical tracks 60 and the corresponding electrical brushes 62 is maintained even when the frame 50 is rotated. Accordingly, the electrical connection between a media plug 20 and the communications card device 12 is not compromised by the functionality of rotatably mounting the frame 50 to the communications card device 12.

As previously addressed, one of the benefits of the present invention is that the frame 50 can be slidably retracted into the housing of the communications card device 12 during nonuse to protect the aperture 18 and electrical contacts 42 from harmful dust and debris. However, before the frame 50 can be slidably retracted into the housing of the communications card device 12, it must be aligned with a corresponding opening 64 in the housing of the communications card device 12. It should be appreciated by one skilled in the art that detents or raised surfaces 61 can be formed in the frame 50 to aid a user in aligning the frame 50 with the opening 64 by providing a means for the user to feel differences in torque when rotating the frame 50 to know when the frame 50 is aligned with the opening 64 without having to visually inspect the alignment. When the frame 50 is aligned, it can be slidably retracted into the housing of the communications card. To prevent the electrical brushes 62 from being damaged, they are also retracted with the frame 50.

Figure 4:
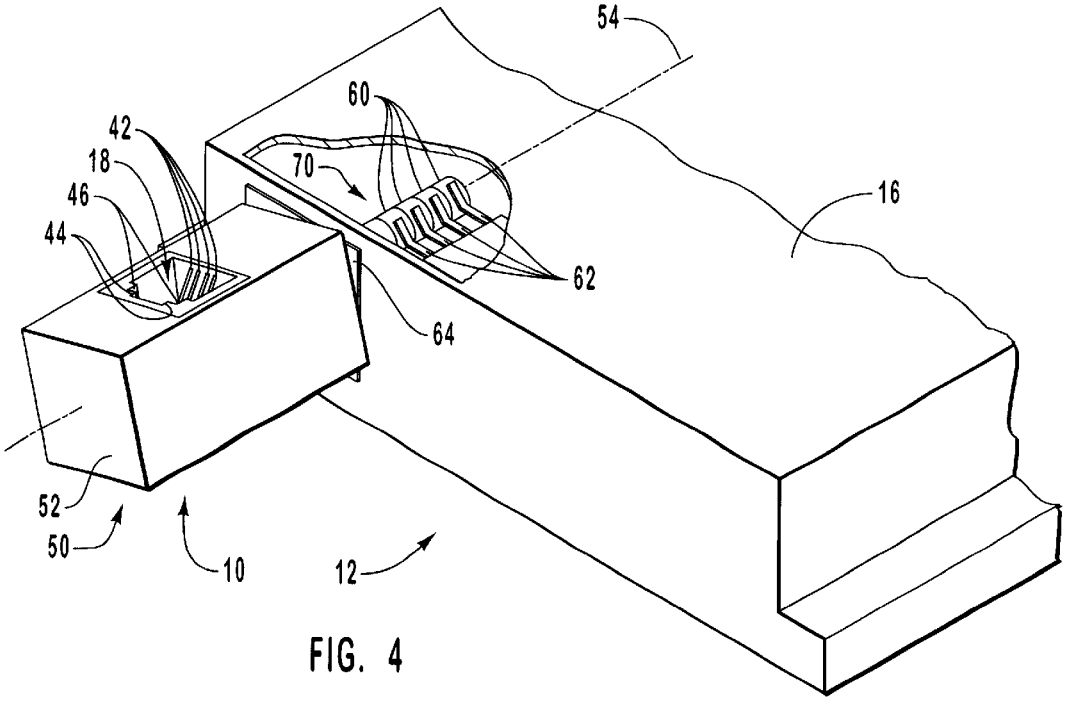
FIG. 4 illustrates a front perspective view of one presently preferred embodiment of the extendable media connector of the present invention that includes an aperture extending into a rectilinear and slidably retractable frame and a rotatable electrical interface comprising an armature that is in contact with electrical brushes of a communications card device.

FIG. 4 illustrates one alternative embodiment of the rotatable electrical interface of the present invention. In this embodiment, the rotatable electrical interface comprises an armature 70 having electrical tracks 60 disposed on a cylindrical shaft. As shown, the electrical brushes 62 rest on the electrical tracks 60 of the armature 70, thereby maintaining electrical contact between the rotatable electrical interface and the electrical brushes 62 at all times, even when the frame 50 is rotated about the central axis 54.

Figure 5:
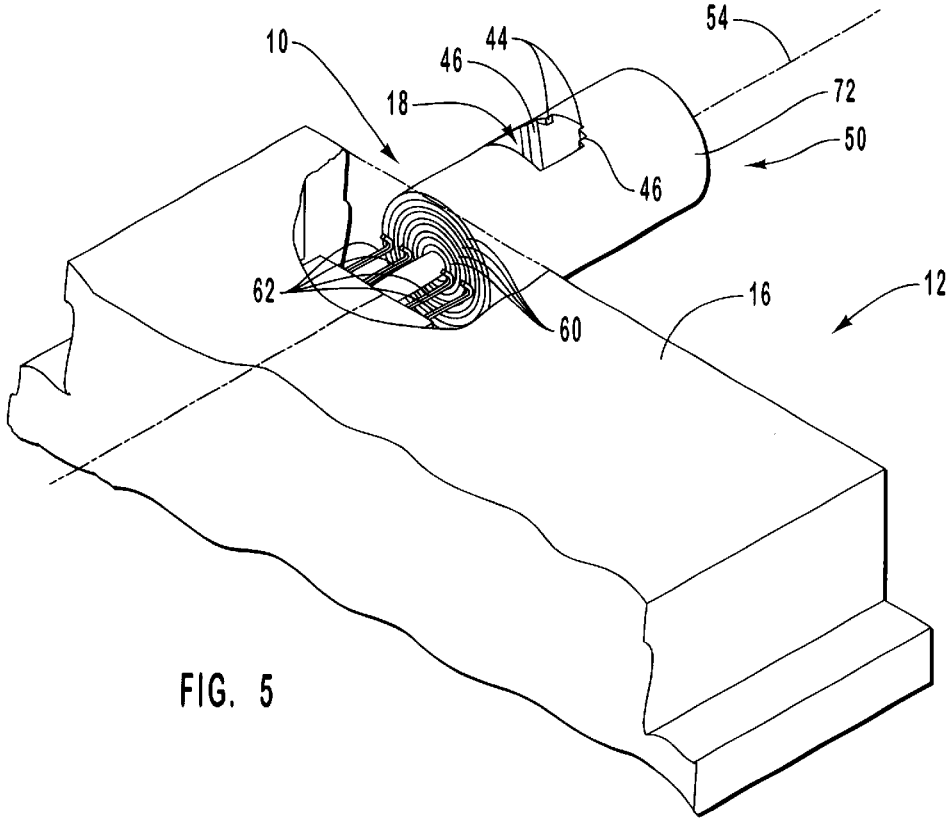
FIG. 5 illustrates a back perspective view of one presently preferred embodiment of the extendable media connector of the present invention that includes an aperture extending into a cylindrical and slidably retractable frame and a rotatable electrical interface comprising a plurality of electrical tracks that are in contact with electrical brushes of a communications card device.

FIG. 5 illustrates another embodiment of the extendable media connector 10 of the present invention. In this embodiment, the frame 50 comprises a cylindrical block 72 that is rotatably mounted to a communications card device 12. The cylindrical frame 50 rotates about a central axis 54 that extends through the center of the frame 50. This embodiment may be preferred in some circumstances because the cylindrical block 72 frame 50 does not have to be rotated into a specific alignment with the opening 64 in the housing of the communications card device 12 before it is slidably retracted into the housing because the frame 50 and the housing have the same shape and are in perpetual alignment.

Figure 6:
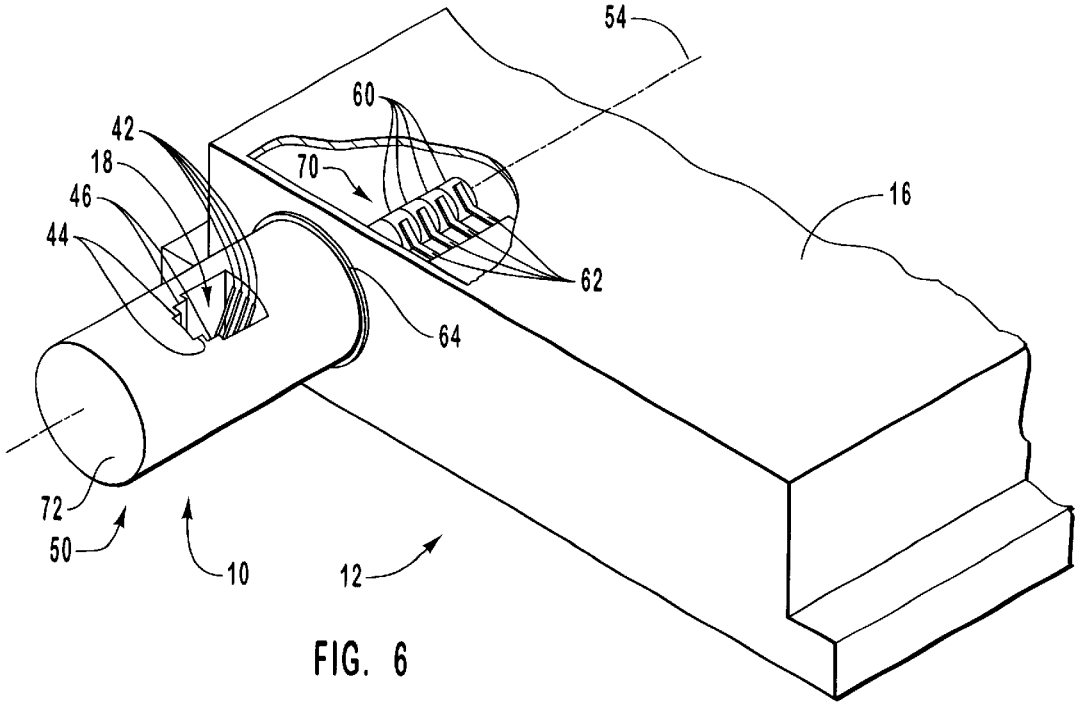
FIG. 6 illustrates a front perspective view of one presently preferred embodiment of the extendable media connector of the present invention that includes an aperture extending into a rectilinear and slidably retractable frame and a rotatable electrical interface comprising an armature that is in contact with electrical brushes of a communications card device.

Also shown in FIG. 5, the rotatable electrical interface comprises a plurality of electrical tracks 60 that are disposed on a substantially flat surface and are in contact with corresponding electrical brushes 62 of the communications card device 12. It should be appreciated, however, that the configuration of electrical tracks 60 and electrical brushes 62 can be modified without departing from the spirit of the present invention. For example, the electrical brushes 62 may be mounted on the frame 50 and the electrical tracks 60 may be mounted on the communications card device 12, completely opposite of the depicted embodiment. Alternatively, as shown in FIG. 6, the electrical tracks 60 may be mounted on an armature 70.

Figure 7:
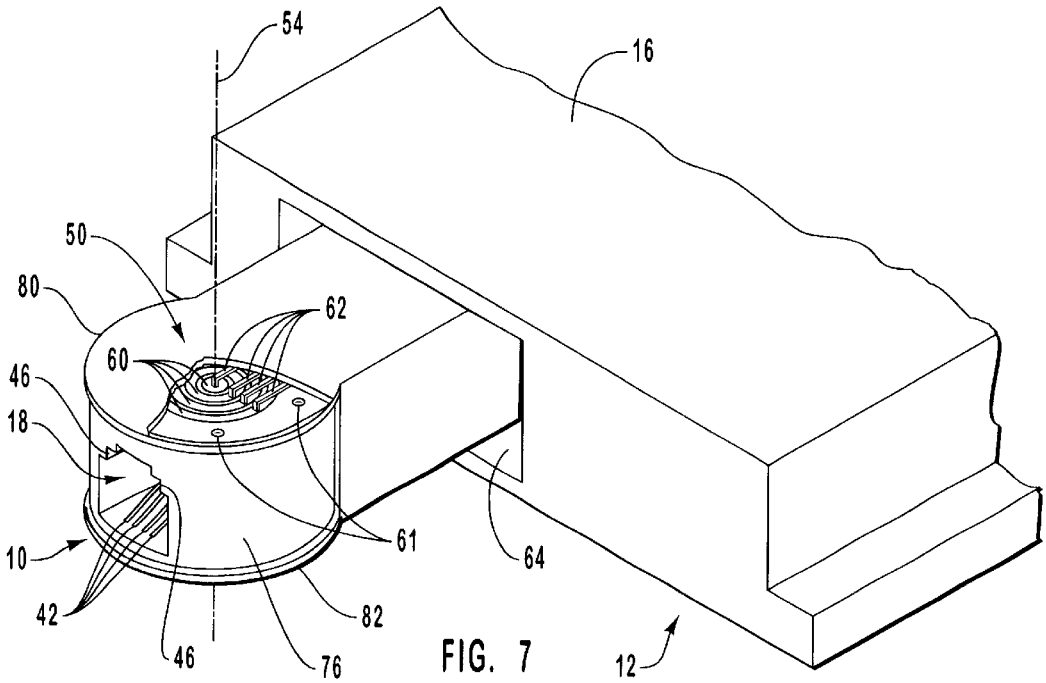
FIG. 7 illustrates a front perspective view of one presently preferred embodiment of the extendable media connector of the present invention that includes an aperture extending into a cylindrical block that is rotatably attached to a slidably retractable rectilinear block and a rotatable electrical interface comprising a plurality of electrical tracks.

FIG. 7 illustrates yet another embodiment of the extendable media connector 10 of the present invention. In this embodiment, the frame 50 comprises a cylindrical block 76 that is rotatably mounted to a rectilinear block 74 that is slidably retractable into the housing of a communications card device 12. An upper cover plate 80 and a lower cover plate 82 extend out of the rectilinear block 74 and cover the cylindrical block 76, to protecting the cylindrical block when the frame 50 is extended. The cylindrical block 76, mounted on the cover plates 80 and 82 of the rectilinear block 74, can freely rotate around a central axis 54 that extends through the center of the cylindrical block 76.

In this presently preferred embodiment, the rotatable electrical interface is located on the top surface of the cylindrical block 76. The rotatable electrical interface comprises a plurality of electrical tracks 60 that are in contact with corresponding electrical brushes 62 of the communications card device 12 that are mounted on the slidably retractable rectilinear block 74.

One benefit of this presently preferred embodiment is that a media plug 20 can be coupled within the aperture 18 of the frame 50 while the frame 50 is extended and can remain coupled within the aperture 18 when the frame 50 is slidably retracted within the housing of a communications card device 12. This embodiment may be preferred by users who like the functionality of a slidably retractable frame 50 but do not want the frame 50 to extend away from the communications card device 12 after the media plug 20 has been inserted into the aperture 18 of the frame 50 for various reasons, such as aesthetics.

Using this embodiment, a user can initially extend the frame 50 away from the communications card device 12 to facilitate the insertion of a suitable media plug 20 into the aperture 18 of the frame 50. After a media plug 20 has been inserted into the aperture 18, the frame 50 can be slidably retracted into the housing of the communications card device 12 without removing the media plug 20 from the aperture 18. It should be appreciated that even when the frame 50 is slidably retracted, it retains the benefits previously attributed to the present invention. In particular, the cylindrical block 76 can rotate, even while retracted, so as to provide slack when an inadvertent force is applied to a cable 24 of a media plug 20 that is mechanically secured within the aperture 18, to minimize the potential for damage to the cable 24, the media plug 20, and the extendable media connector 10.

During nonuse, after the media plug 20 is removed, the aperture 18 can be rotated behind the protective profile of the rectilinear block 74 so as to protect the aperture 18 and electrical contacts 42 from ancillary damage and the harmful accumulation of dust and debris. To assist a user in rotating the aperture 18 behind the protective profile of the rectilinear block 74, the cylindrical 72 and rectilinear blocks 74 can be equipped with interacting irregular surfaces and detents 61 that enable the user to feel differences in torque, while rotating the cylindrical block 76, that indicate when the aperture 18 is successfully positioned behind the protective profile of the rectilinear block 74 without requiring the user to make a visual confirmation.

Figure 8:
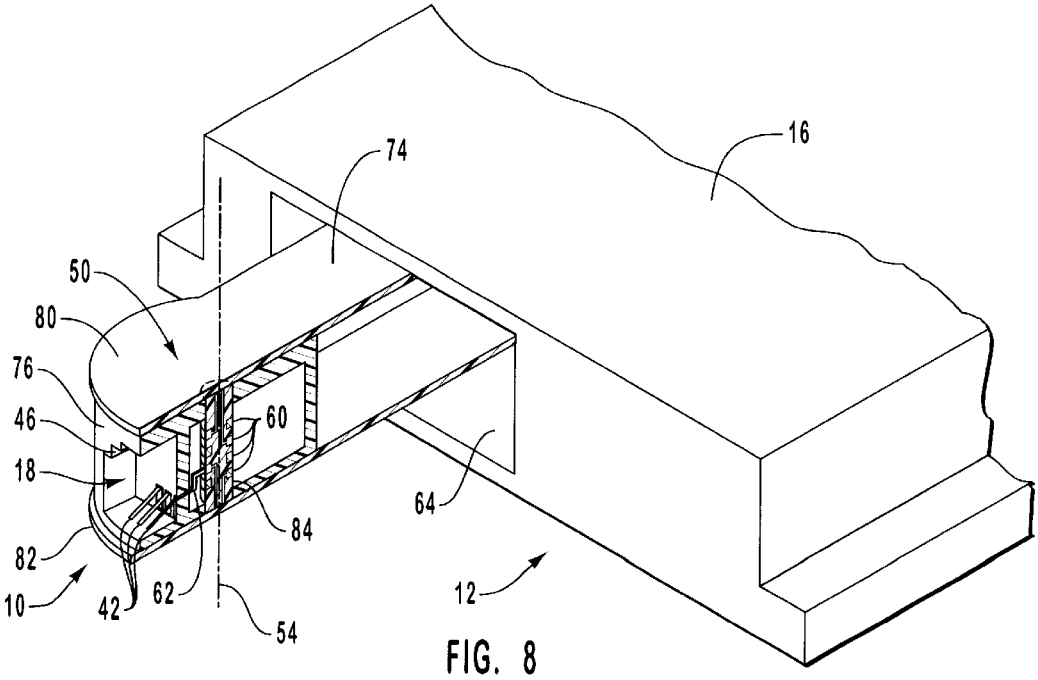
FIG. 8 illustrates a partial cross-sectional side view of one presently preferred embodiment of the extendable media connector of the present invention that includes an aperture extending into a cylindrical block that is rotatably attached to a slidably retractable rectilinear block and a rotatable electrical interface comprising a plurality of electrical brushes that are in contact with electrical tracks disposed on a shaft that extends through the center of the cylindrical block.

In one variation of this presently preferred embodiment, shown in FIG. 8, the cylindrical block 76 is rotatably mounted to the rectilinear block 74 by a shaft 84 that extends between the upper and lower cover plates. In this embodiment, the electrical contacts 42 extend through the shaft 84 and terminate in electrical brushes 62 that make electrical contact with electrical tracks 60 that are located on the shaft 84. The electrical tracks 60 are connected to contact wires that extend to the communications card device 12 through the shaft 84, the cover plates and the rectilinear block 74. Even though this example has gone into some detail regarding a specific configuration of electrical tracks 60 and electrical brushes 62, it should be construed as merely illustrative. One skilled in the art will appreciate that there are various armature and commutator configurations that can be incorporated by the present invention without departing from the spirit of the present invention.

Accordingly, the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed and desired to be secured by United States Letters Patent is:

1. An extendable media connector, comprising:

a slidably retractable frame for operably extending to facilitate electrical and mechanical interconnection from a device, said frame including:

a block capable of rotation with respect to said device when extended from said device, said block having an aperture therein for physically receiving and retaining a media plug;

at least one electrical contact within said aperture for electrically engaging with complementary electrical contacts on said media plug; and a rotatable electrical interface between said block and said device for providing electrical continuity between said at least one electrical contact and said device throughout rotation of said retractable frame, said rotatable electrical interface retracting and extending with said frame.

2. An extendable media connector as recited in claim 1, wherein said device comprises a housing, and wherein said frame is slidably retractable into said housing of said device.

3. An extendable media connector as recited in claim 1, wherein said aperture extends into a side of said slidably retractable frame.

4. An extendable media connector as recited in claim 2, wherein said block comprises a rectilinear block that is rotatably mounted to said device.

5. An extendable media connector as recited in claim 2, wherein said block comprises a cylindrical block that is rotatably mounted to said device.

6. An extendable media connector as recited in claim 1, wherein said media plug is one of either an RJ-11 series plug and an RJ45 series plug.

7. An extendable media connector as recited in claim 1, wherein said rotatable electrical interface comprises at least one electrical brush that makes electrical contact with said at least one electrical contact of said retractable frame.

8. An extendable media connector as recited in claim 1, wherein said rotatable electrical interface comprises at least one electrical track that makes electrical contact with said at least one electrical brush.

9. An extendable media connector as recited in claim 7, wherein said rotatable electrical interface further comprises an armature.

10. An extendable media connector as recited in claim 1, wherein said frame mechanically secures the physical/electrical media plug within said aperture by latching onto a retention clip of said media plug when a body of said media plug is inserted into said aperture.

11. An extendable media connector as recited in claim 1, wherein said device has a PCMCIA type-III architecture.

12. An extendable media connector of a type-III PCMCIA card having an electric circuit therein, said connector for coupling with an RJ-Series media plug having a body, a retention clip, and contact pins, the extendable media connector comprising:

(a) a frame having an aperture extending into a side of the frame that is configured to receive the body of the RJ-Series media plug, wherein the frame is rotatably mounted to the type-III PCMCIA card and slidably retractable into the type-III PCMCIA card;

(b) a rotatable electrical interface attached to the frame such that any rotation of the frame causes an equal rotation of the rotatable electrical interface with respect to said card, said rotatable electrical interface retracting and extending with said frame; and (c) electrical contacts that bias against the contact pins of the media plug when the body of the media plug is inserted into the aperture of the frame.

13. An extendable media connector as recited in claim 12, wherein said frame comprises one of either a rectilinear block and a cylindrical block.

14. An extendable media connector as recited in claim 12, wherein said frame mechanically secures the RJ-series media plug within said aperture by latching onto the retention clip of the RJ-series media plug when the body of said RJ-series media plug is inserted into said aperture.

15. An extendable media connector as recited in claim 12, wherein said RJ-series media plug is one of either an RJ-11 and an RJ-45 series plug.

16. A communications card device comprising:

(a) a housing;

(b) an extendable media connector having a frame with an aperture extending therein that is configured to couple with a physical/electrical media plug having a body, a retention clip, and contact pins;

(c) a rotatable electrical interface for providing electrical continuity between said frame and said housing during rotation therebetween, said rotatable electrical interface retracting and extending with said frame; and (d) electrical contacts for making electrical contact with the rotatable electrical interface.

17. An extendable media connector as recited in claim 16, wherein said aperture extends into the side of the frame.

18. An extendable media connector as recited in claim 16, wherein said frame is slidably retractable into the housing of said communications device.

19. An extendable media connector as recited in claim 18, wherein said frame comprises a rectilinear block that is rotatably mounted to the communications card device.

20. An extendable media connector as recited in claim 18, wherein said frame comprises a cylindrical block that is rotatably mounted to the communications card device.

21. An extendable media connector as recited in claim 16, wherein said physical/electrical media plug is one of either an RJ-11 plug and RJ-45 plug.

22. An extendable media connector as recited in claim 16, wherein said communications card device comprises a plurality of electrical brushes that make electrical contact with said rotatable electrical interface.

23. An extendable media connector as recited in claim 22, wherein said rotatable electrical interface comprises a substantially flat surface having a plurality of electrical tracks.

24. An extendable media connector as recited in claim 22, wherein said rotatable electrical interface comprises an armature.

25. An extendable media connector as recited in claim 16, wherein said frame mechanically secures the physical/ electrical media plug within said aperture by latching onto the retention clip of the physical/electrical media plug when the body of said physical/electrical media plug is inserted into said aperture.

26. An extendable media connector as recited in claim 16, wherein said contact pins of the physical/electrical media plug bias against the electrical contacts of the extendable media connector when the body of said physical/electrical media plug is inserted into said aperture.

27. An extendable media connector as recited in claim 16, wherein said rotatable electrical interface is attached to the frame, such that any rotation of the frame causes an equal rotation of the rotatable electrical interface.

28. An extendable media connector as recited in claim 16, wherein said communications card device has a PCMCIA type-III architecture.

* * * * *